US008980084B2

(12) United States Patent
Dorsey

(10) Patent No.: US 8,980,084 B2
(45) **Date of Patent: *Mar. 17, 2015**

(54) FILTER ASSEMBLY FOR USE IN DRAINAGE SYSTEM

(71) Applicant: Russell N. Frye, Newark, OH (US)

(72) Inventor: Michael P. Dorsey, Roseville, OH (US)

(73) Assignee: Russell N. Frye, Newark, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/154,827

(22) Filed: Jan. 14, 2014

(65) Prior Publication Data

US 2014/0124422 A1 May 8, 2014

Related U.S. Application Data

(63) Continuation of application No. 11/700,597, filed on Jan. 31, 2007, now Pat. No. 8,652,323.

(51) Int. Cl.

| | |
|---|---|
| ***E03F 5/06*** | (2006.01) |
| ***E03F 5/14*** | (2006.01) |
| ***E03F 1/00*** | (2006.01) |
| ***E03F 5/04*** | (2006.01) |
| ***E03F 5/046*** | (2006.01) |

(52) U.S. Cl.

CPC ... *E03F 5/06* (2013.01); *E03F 1/00* (2013.01); *E03F 5/0404* (2013.01); *E03F 5/046* (2013.01); *E03F 5/14* (2013.01)

USPC ..... 210/163; 210/164; 404/4

(58) Field of Classification Search

None

See application file for complete search history.

(56) References Cited

U.S. PATENT DOCUMENTS

| | | | | |
|---|---|---|---|---|
| 7,758,747 | B2 * | 7/2010 | Bryant | 210/162 |
| 7,799,235 | B2 * | 9/2010 | Olson et al. | 210/767 |
| 7,879,233 | B2 * | 2/2011 | Shaw et al. | 210/164 |
| 7,959,799 | B2 * | 6/2011 | Happel et al. | 210/163 |
| 8,012,346 | B2 * | 9/2011 | Peters et al. | 210/170.03 |
| 8,017,006 | B2 * | 9/2011 | Lopez | 210/163 |
| 8,034,237 | B2 * | 10/2011 | Happel et al. | 210/170.03 |
| 8,051,568 | B2 * | 11/2011 | Moody et al. | 29/896.62 |
| 8,123,935 | B2 * | 2/2012 | Murray et al. | 210/108 |
| 8,158,010 | B2 * | 4/2012 | Pearse et al. | 210/747.1 |
| 8,168,064 | B2 * | 5/2012 | Peters et al. | 210/163 |
| 8,182,702 | B2 * | 5/2012 | Al-Sannaa | 210/806 |
| 8,216,479 | B2 * | 7/2012 | Lambert et al. | 210/747.3 |
| 8,221,618 | B2 * | 7/2012 | Murray et al. | 210/108 |
| 8,287,726 | B2 * | 10/2012 | Williams et al. | 210/108 |
| 8,535,523 | B2 * | 9/2013 | Friezner et al. | 210/156 |
| 8,557,108 | B2 * | 10/2013 | Rennels | 210/163 |
| 8,557,109 | B1 * | 10/2013 | Sutherland | 210/163 |
| 8,652,323 | B2 * | 2/2014 | Dorsey | 210/164 |
| 2008/0047886 | A1 * | 2/2008 | Lambert et al. | 210/163 |
| 2008/0179229 | A1 * | 7/2008 | Dorsey | 210/163 |
| 2011/0278237 | A1 * | 11/2011 | McInnis | 210/767 |
| 2014/0124422 | A1 * | 5/2014 | Dorsey | 210/163 |

* cited by examiner

*Primary Examiner* — Robert James Popovics

(74) *Attorney, Agent, or Firm* — Jason H. Foster; Kremblas & Foster

(57) ABSTRACT

A filter assembly for use in drainage systems to prevent the buildup of eroded materials such as soil, leaves and other debris. The assembly includes a unitary frame and a filter media attached to the frame and is adapted to be retained within a component of a drainage sewer such as a catch basin. A porous material filter media such as a woven or non-woven geotextile allows for the flow of water through the filter while retaining debris or soil within the filter. The filter media extends into the basin to provide volume for the retained material without blocking the entire surface of the filter.

8 Claims, 5 Drawing Sheets

FILTER ASSEMBLY FOR USE IN DRAINAGE SYSTEM

TECHNICAL FIELD AND INDUSTRIAL APPLICABILITY OF THE INVENTION

The present invention relates to filter assemblies for use in drainage systems to prevent the buildup of eroded materials such as soil, leaves and other debris within the drainage system. The assembly includes a unitary frame and a filter media attached to the frame. The assembly is adapted to be retained within a component of a drainage sewer such as a catch basin. The frame is inserted into an inlet to the drainage system such as a gutter inlet and is supported within the inlet. The filter media is formed of a porous material such as a woven or non-woven geotextile to allow for the flow of water through the filter while retaining debris or other materials within the filter. The filter media extends into the basin to provide volume for the retained material without blocking the entire surface of filter.

BACKGROUND OF THE INVENTION

Typical drainage systems collect surface water within underground drainage systems to prevent flooding. In a typical drainage system a number of inlets are connected to an underground storm sewer system. An inlet typically includes a removable cast iron grate that inhibits the flow of some large debris into the inlet. The grate may include openings of up to four inches or longer and allows the flow of debris into the drainage system. The debris builds up within the drainage system and will block the flow of water through the system and may cause localized flooding. In order to maintain the flow of water it is necessary to clean the drainage system. This cleaning is typically performed with a great deal of physical effort and a truck equipped with a vacuum hose to remove the debris from the system.

It is known to place a filtering screen above or below the storm drain grate to collect smaller items of debris that may pass through the grate. These prior art filters are easily blocked by a buildup of debris or soil on the filter. Complicated structures have been developed to allow an increased sump area for collection of debris within the catch basin. These structures require rings or hooks that penetrate and weaken the filter media. Another prior art device, as shown in U.S. Pat. No. 6,294,095, includes a frame that is inserted into the drainage system and a number of rods that are fitted to and retained by the frame to retain the filter media.

BRIEF SUMMARY OF THE INVENTION

The present invention relates to filter assemblies for use in a drainage system to prevent the buildup of eroded materials such as soil, leaves and other debris in the system. The assembly includes a unitary frame and a filter media attached to the frame. The frame is inserted into an inlet to the system such as a gutter inlet and is supported within the inlet. The filter media is formed of a porous material such as a woven or non-woven geotextile to allow for the flow of water through the filter while retaining the eroded materials within the filter. The filter media extends into the inlet to provide volume for the retained material without blocking the entire surface of the filter.

DETAILED DESCRIPTION AND PREFERRED EMBODIMENTS OF THE INVENTION

U.S. application Ser. No. 11/700,597 filed Jan. 31, 2007 is hereby incorporated by reference.

Figure 1:
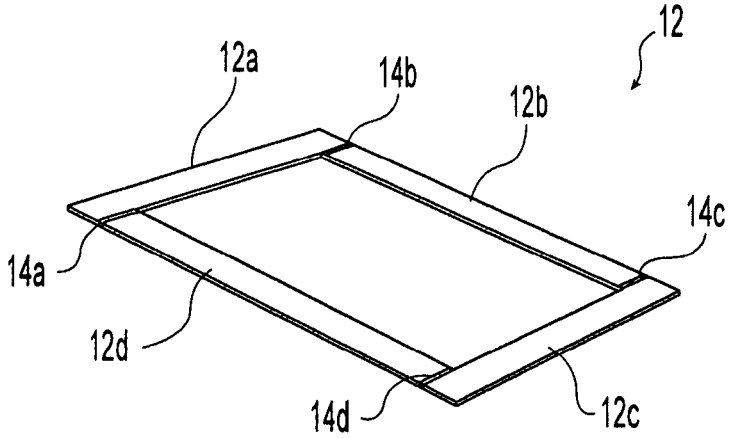
FIG. 1 shows a perspective view of a frame in accordance with the present invention.

With respect to the figures, FIG. 1 shows a frame suitable for use in the filter assembly of the present invention. The frame may be of any shape and is configured to fit within an inlet to a drainage system. The frame 12, as shown, includes frame members 12*a*, 12*b*, 12*c* and 12*d* and welds 14*a*, 14*b*, 14*c* and 14*d* to form a rectangular frame. Other suitable frames may be square, round, oblong or any other shape to match the drainage system inlet. One suitable material for use in forming the frame is ½" by ⅛" steel. The use of steel provides a rigid frame that inhibits bending when a loaded filter element is removed from a drainage system and is easily fabricated by welding. Any material that provides suitable strength, and can be fabricated to the desired shape, may be used.

Figure 2:
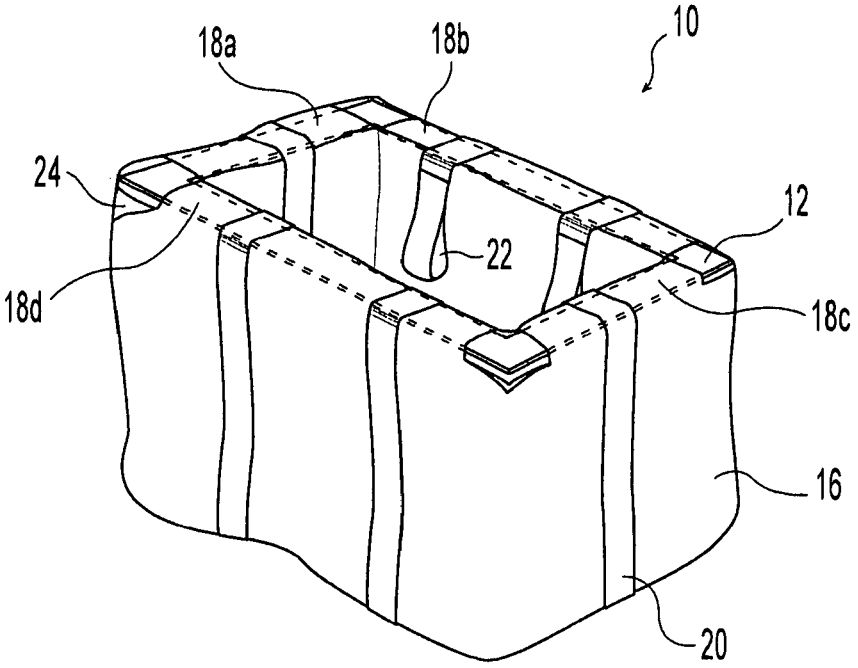
FIG. 2 shows a perspective view of a frame and filter media in accordance with the present invention.

As shown in FIG. 2, system 10 generally includes a frame 12 and filter media 16, which allows water to flow through the filter media 16 while collecting debris. The system includes a sump area, in which debris is collected, formed by the filter media 16 and frame 12. The filter media 16 is preferably connected to the frame by one or more pockets sewn into the filter area. As shown in FIG. 2, pockets 18*a*, 18*b*, 18*c* and 18*d* encompass the frame members 12*a*, 12*b*, 12*c* and 12*d* (shown in FIG. 1). In the event of a round frame (not shown) one or more pockets are used. The pockets are preferably formed by doubling the filter material over around the upper edge of the filter material and sewing the double layer to form the pocket. The pocket is generally formed prior to insertion of the frame into the pocket and a final weld is performed after the system 10 is assembled. It is also possible to form the frame and sew the filter media to the frame. The use of sewn pockets rather than the hooks or bolts of the prior art allows for increased strength, improved reliability and easier use in the field.

The assembly 10 may also include webbing 20 extending across the filter for supporting the weight of the debris within the sump, and loops 22 of webbing 20 that extend above the frame 12 to aid in lifting the filter assembly from a drainage system. In a preferred embodiment, the filter is a woven geotextile material with a water flow rate greater than about 100 gallons/minute/ft$^2$ and preferably has a water flow rate greater than about 145 gallons/minute/ft$^2$. The assembly 10 may include corner cutouts 24 to allow overflow in the event that the sump area of filter 16 is completely filled.

One suitable filter media is TerraTex EP-12, woven geotextile available from WebTec, LLC of Charlotte, N.C. The TerraTex EP-12 has a tensile strength of 365/2001b (ASTM D-4632); a puncture strength of 90 lb (ASTM D-4833) and a water flow rate of 145 gallons/minute/ft$^2$ (ASTM D-4491). A suitable webbing is a 2" polypropylene webbing available from Tape Craft of Oxford Alabama, which has a tensile strength of 1050 lbs. When manufactured using TerraTex EP-12, woven geotextile and 2" polypropylene webbing an assembly 10 having a length of 16" and width of 35" will hold over 600 lb of wet soil without failure.

Figure 3:
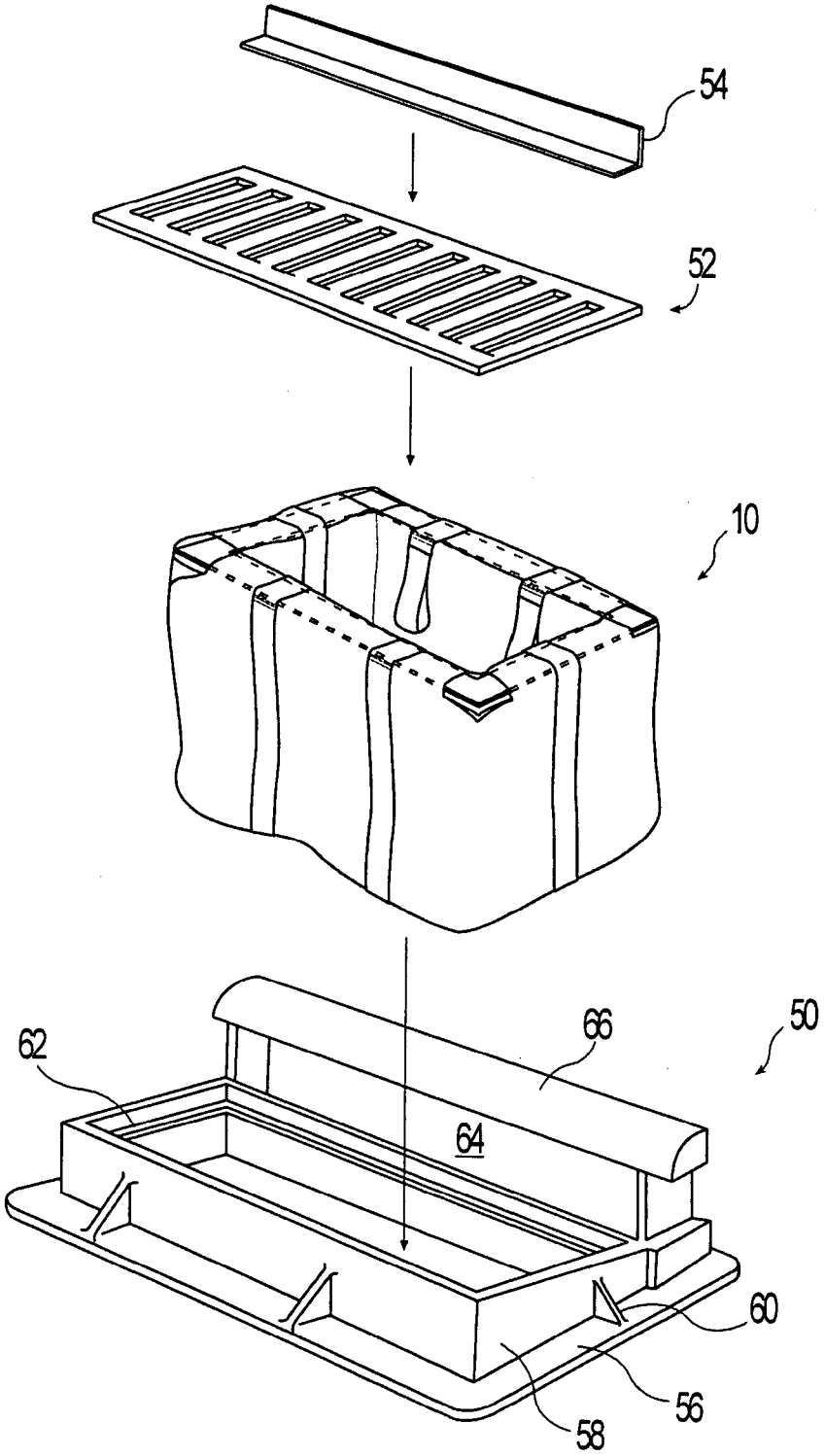
FIG. 3 shows an exploded perspective view of the system shown in FIG. 2, including a drainage grate and frame.

FIG. 3 shows an assembly 10 of the present invention suitable for installation in a curb drain 50. The drain 50 includes a flange 56 configured to be placed on top of a catch basin (not shown), a peripheral side wall 58 and supports 60 to strengthen the side wall 58, and a bonnet 66 above overflow 64. On the interior of the side wall 58 is a protrusion or detent 62 that supports grate 52. The filter assembly 10 is inserted into drain 50 so that frame 12 rests on detent 62 and grate 52 is placed above the frame. An L-bracket 54 may be placed on the grate to inhibit the flow of debris into overflow 64.

Figure 4:
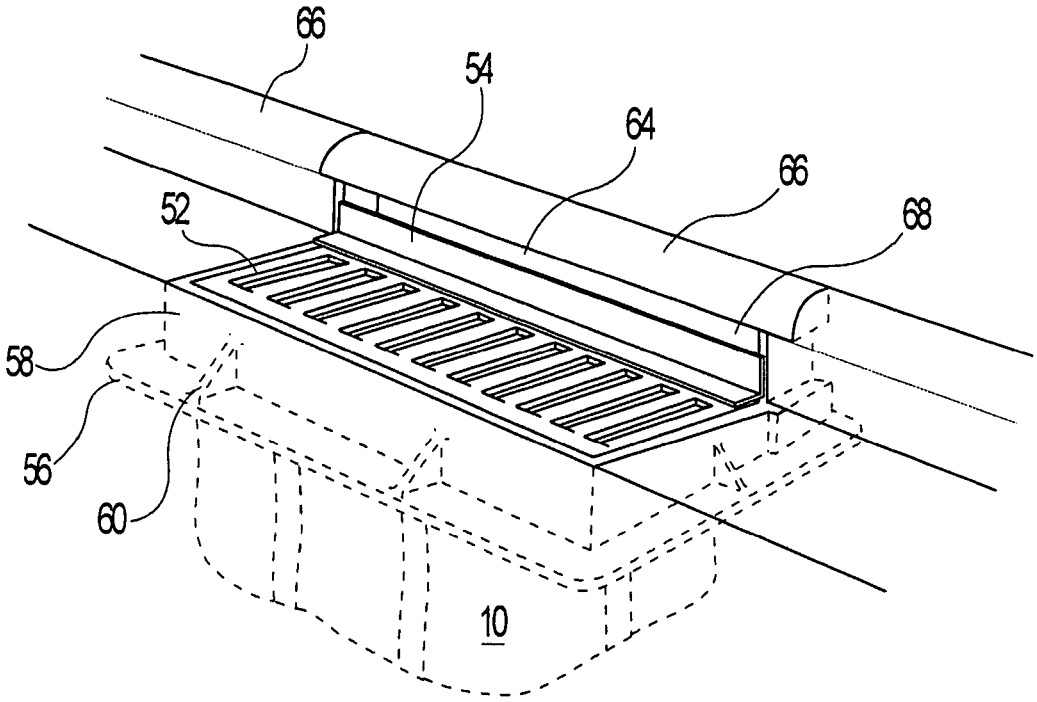
FIG. 4 shows the system of FIG. 3 installed in a curb.

FIG. 4 shows an assembly 10 in a curb drain 50. The drain 50 is fixed in curb 66 with flange 56 place on top of a catch basin (not shown), the peripheral side wall 58 and supports 60 are positioned beneath road level while bonnet 66 and overflow 64 are above the road and within the curb 66. The filter assembly 10 is inserted into drain 50 and grate 52 is placed above the frame. An L-bracket 54 is shown on the grate 52 to inhibit the flow of debris into overflow 64.

Figure 5:
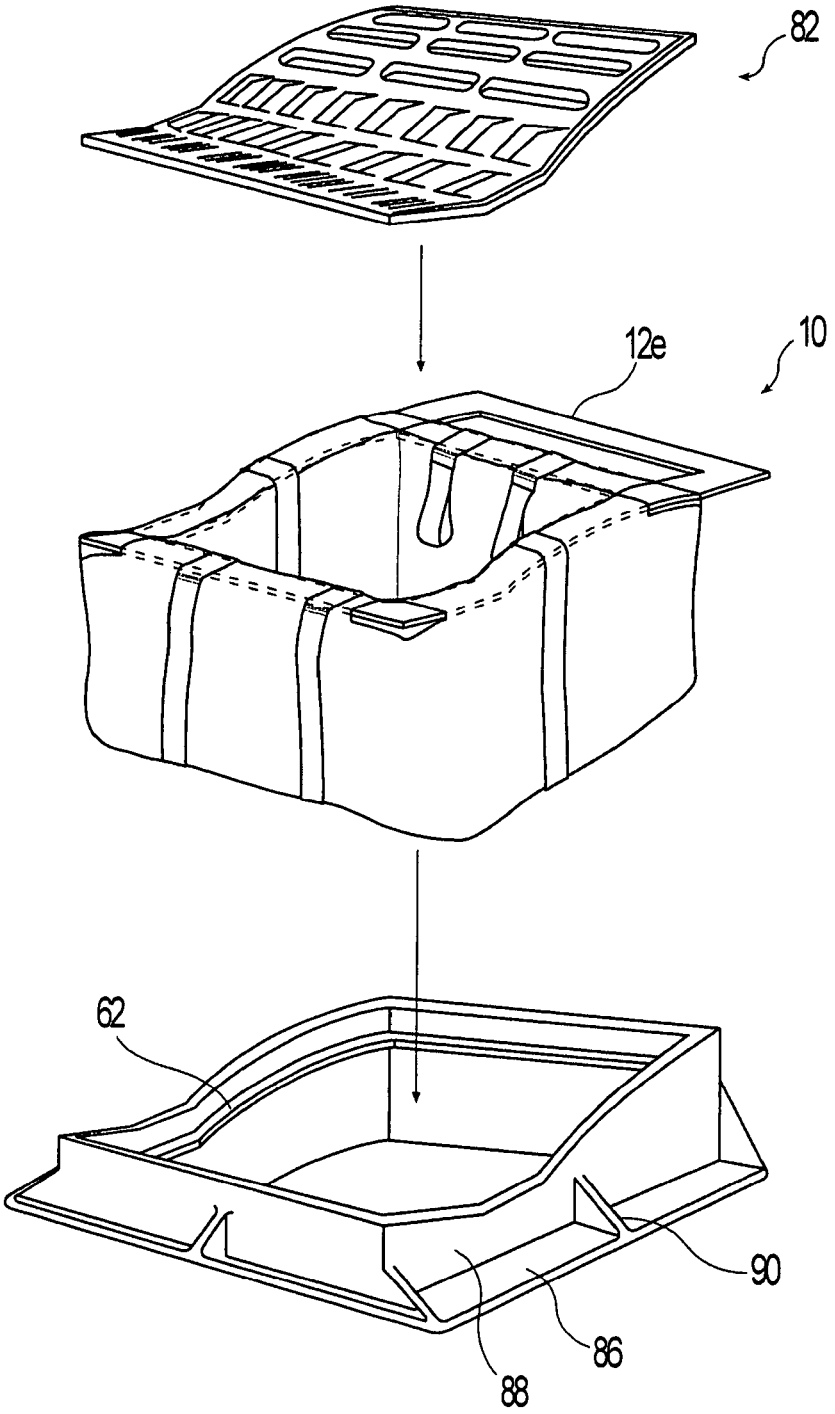
FIG. 5 shows an exploded perspective view of an alternative system according to the present invention, including a curb and gutter drainage grate and frame.

FIG. 5 shows an assembly 10 of the present invention suitable for installation in a curb and gutter drain 50. The drain 50 is configured to match a rolled curb so that frame 12 is non-planar and matches the shape of the grate 82. It may also be preferable to include an additional frame member 12*e*. The additional frame member 12*e* allows for the filter assembly to allow overflow directly to the catch basin (not shown). Similar to FIG. 3, the drain 50 includes a flange 56 configured to be placed on top of a catch basin (not shown), a peripheral side wall 88 and supports 90 to strengthen the side wall 88. The grate 82 matches the shape of the curb so a bonnet, as shown in FIG. 3, is unnecessary. The uppermost row of orifices in the grate 82 serves as the overflow for the system. The additional frame member 12*e* allows unrestricted flow of water from the grate 82 to the catch basin (not shown) in the event that the assembly 10 is filled. A protrusion or detent 62 supports grate 82 and matches the curvature of the grate. The filter assembly 10 is inserted into drain 50 so that frame 12 rests on detent 62 and grate 82 is placed above the frame.

Figure 6:
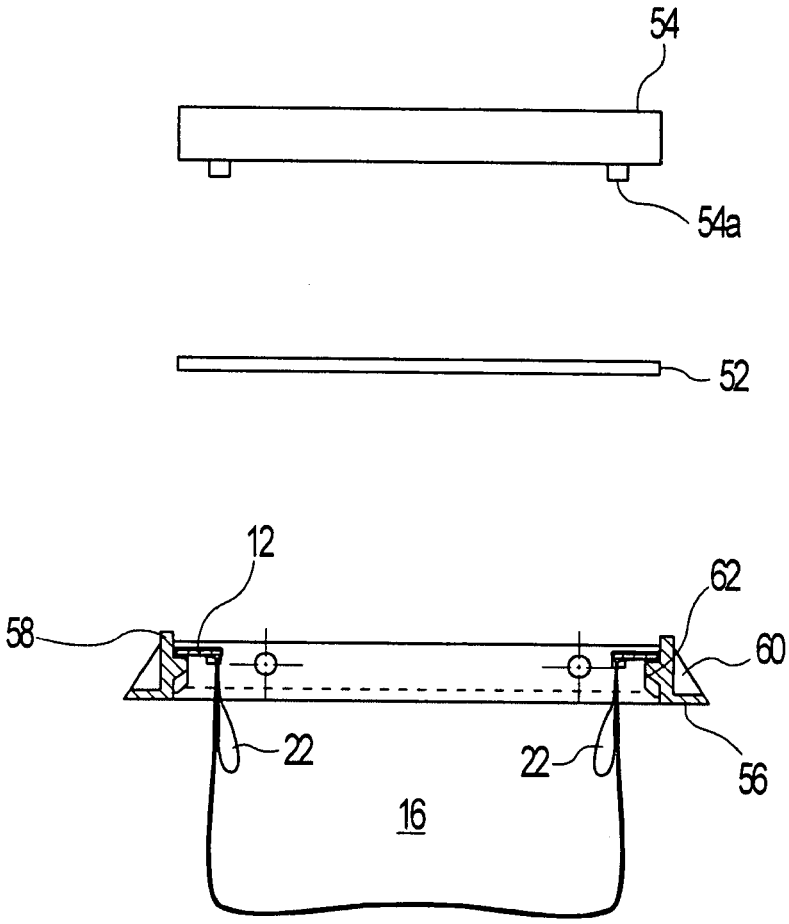
FIG. 6 shows a cross-sectional view of FIG. 3.

FIG. 6 shows a cross-section of a drain 50 with flange 56 , a peripheral side wall 58 and supports 60. The filter assembly 10 is inserted into drain 50 so that frame 12 rests on detent 62 with filter media 16 hanging below drain 50. The grate 52 and an L-bracket 54 are inserted into the side wall 58 so that tabs 54*a* are pinched between grate 52 and peripheral side wall 58. It is preferred that the tabs 54*a* are set in from the end of L-bracket 54 by at least ⅜" so that the edges of the L-bracket extend to the bonnet (as shown in FIG. 4).

The invention of this application has been described above both generically and with regard to specific embodiments. Although the invention has been set forth in what is believed to be the preferred embodiments, a wide variety of alternatives known to those of skill in the art can be selected within the generic disclosure. The invention is not otherwise limited, except for the recitation of the claims set forth below.

The invention claimed is:

1. A filter in combination with a drainage system including a grate assembly, the grate assembly having a detent extending inwardly from a peripheral sidewall to form an upwardly-facing surface supporting a downwardly-facing surface of a removable drainage grate, the filter comprising:

(a) an enclosed loop frame sandwiched between the downwardly facing surface of the grate and the detent's upwardly facing surface, the frame encircling an interior space;

(b) a filter media having a sump area for collecting debris, an upper edge, and at least one pocket formed around said upper edge enclosing at least a portion of the frame;

(c) at least a first supportive webbing extending contiguously from a first side of the upper edge beneath the filter media sump area to a second side of the upper edge opposite the first side, the first supportive webbing having opposing ends attached to an outside surface of the filter media at said at least one pocket, beneath the grate, and within the frame's interior space;

(d) at least a second supportive webbing extending contiguously from a third side of the upper edge beneath the filter media sump area to a fourth side of the upper edge opposite the third side, the second supportive webbing having opposing ends attached to an outside surface of the filter media at said at least one pocket, beneath the grate, and within the frame's interior space;

wherein the first and second supportive webbings cross at a transverse intersection beneath the sump area to support the weight of any debris in the sump area; and wherein all portions of the filter remain substantially below an upwardly-facing surface of the grate in operable orientation.

2. The combination filter and drainage system of claim 1, wherein said filter is a woven geotextile material.

3. The combination filter and drainage system of claim 1, wherein the pocket is formed by doubling the filter material over to form a double layer of filter material around the upper edge of the filter material and sewing the double layer to form the pocket; and further comprising webbing sewn across said filter for supporting debris within said sump area.

4. The combination filter and drainage system of claim 1, wherein the one piece frame comprises:

(a) first and second substantially parallel frame members;

(b) third and fourth substantially parallel frame members that are perpendicular to said first and second frame members, whereby the first, second, third and fourth frame members support the filter media and have a thickness that is substantially smaller than a width, where the thickness is measured across a gap between the downwardly facing surface of the grate and the detent's upwardly facing surface; and (c) a plurality of welds between the first, second, third and fourth frame members forming a one piece frame.

5. A filter in combination with a drainage system including a grate assembly, the grate assembly having a detent extending inwardly from a peripheral sidewall to form an upwardly-facing surface supporting a downwardly-facing surface of a removable drainage grate, the filter comprising:

(a) a one piece, enclosed loop frame sandwiched between the downwardly facing surface of the grate and the detent's upwardly facing surface, the frame encircling an interior space;

(b) a filter media having a sump area for collecting debris, an upper edge, and at least one pocket formed around said upper edge enclosing at least a portion of the frame;

(c) at least a first supportive webbing extending contiguously from a first side of the upper edge beneath the filter media sump area to a second side of the upper edge opposite the first side;

(d) at least a second supportive webbing, spaced a substantial distance from the first supportive webbing, and extending contiguously from the first side of the upper edge beneath the filter media sump area to the second side of the upper edge; and (e) at least a third supportive webbing extending contiguously from a third side of the upper edge beneath the filter media sump area to a fourth side of the upper edge opposite the third side;

wherein the third supportive webbing crosses the first and second supportive webbings at a transverse intersection beneath the sump area to support the weight of any debris in the sump area;

wherein all portions of the filter remain substantially below an upwardly-facing surface of the grate in operable orientation.

6. The combination filter and drainage system of claim 5, wherein said filter is a woven geotextile material.

7. The combination filter and drainage system of claim 5, wherein the pocket is formed by doubling the filter material over to form a double layer of filter material around the upper edge of the filter material and sewing the double layer to form the pocket; and further comprising webbing sewn across said filter for supporting debris within said sump area.

8. The combination filter and drainage system of claim 5, wherein the one piece frame comprises:

(a) first and second substantially parallel frame members;

(b) third and fourth substantially parallel frame members that are perpendicular to said first and second frame members, whereby the first, second, third and fourth frame members support the filter media and have a thickness that is substantially smaller than a width, where the thickness is measured across a gap between the downwardly facing surface of the grate and the detent's upwardly facing surface; and (c) a plurality of welds between the first, second, third and fourth frame members forming a one piece frame.

* * * * *